United States Patent [19]

Barrett

[11] Patent Number: 5,003,437

[45] Date of Patent: Mar. 26, 1991

[54] ILLUMINATED BOAT HOOK STRUCTURE

[76] Inventor: Robert R. Barrett, Ste. 210, 29451 Greenfield Rd., Southfield, Mich. 48076

[21] Appl. No.: 539,145

[22] Filed: Jun. 18, 1990

[51] Int. Cl.[5] ..... F21V 33/00

[52] U.S. Cl. ..... 362/109; 362/102; 362/253; 114/221 R

[58] Field of Search ..... 362/119, 32, 102, 120, 362/186, 253; 43/5; 114/221 R

[56] References Cited

U.S. PATENT DOCUMENTS

| | | | |
|---|---|---|---|
| 2,225,151 | 12/1940 | Borba | 362/102 |
| 2,245,349 | 6/1941 | Lombardi | 362/102 |
| 2,358,867 | 9/1944 | Maden | 362/32 |
| 3,510,643 | 5/1970 | File | 362/119 |

FOREIGN PATENT DOCUMENTS

| | | | |
|---|---|---|---|
| 4459 | of 1902 | United Kingdom | 362/109 |

*Primary Examiner*—James C. Yeung

*Attorney, Agent, or Firm*—Bertram F. Claeboe

[57] ABSTRACT

An illuminated boat hook structure for performance of boat docking and launching operations, particularly at night or other times of low visibility, is disclosed. The structure of this invention comprises a tubular telescoping shaft member supporting therewithin a power source, parabolic reflector and bulb, and associated wiring connected to a manual switch mounted on the shaft member. A significant feature of the invention is the provision at the forward end of the tubular shaft member of a shaped essentially transparent plastic hook member which projects an unidirectional diffused beam of light toward objects which are to be sighted during zero or low visibility boat docking and launching operations. The particular shape of the hook member facilitates performance of these operations.

1 Claim, 1 Drawing Sheet

ILLUMINATED BOAT HOOK STRUCTURE

BACKGROUND OF THE INVENTION

It is known in the art to which this invention pertains that during nocturnal hours the docking and launching of boats of the recreational type can often be a difficult task. In the docking procedure, as is known, a person positioned generally on the bow of the boat utilizes a pole or like means to prevent an unintended collision between the boat and dock, prior to tying the boat to dock structure. At night, many docks are dimly lit, if at all, and for one person to manipulate a pole and flashlight simultaneously clearly requires considerable physical dexterity. Similar problems are presented during launching when the objective, after untying the boat from dock structure, is to push the boat clear of the dock or adjacent craft, prior to accelerating the boat engine(s). As can now be appreciated, boat docking and launching at night utilizing the described technique is at times productive of structural damage to the boat and bodily injuries to crew members. The likelihood of bodily injury is even more manifest when it is recognized that upon occasion boat dockings and launchings are attempted, absent the availability of a pole member, by a person straddling the boat and dock, or lying in a prostrate position on the bow of the boat, in order to exert the pushing or pulling force required.

SUMMARY OF THE INVENTION

Applicant has surmounted the problems and associated disadvantages of prior art boat docking and launching methods by provision of an illuminated boat hook structure featuring a tubular telescoping shaft member supporting therewithin a power source, a parabolic reflector and bulb, and associated wiring connected to manual switch means mounted on the shaft member. Departing significantly from the prior art, and functioning in combination with the elements just described, is the provision at the forward end of the tubular shaft member of an essentially transparent plastic hook member formed to include a smoothly curved hook portion and forwardly extending head portion. The clear plastic hook member of this invention in association with the structure previously noted is effective to project an unidirectional diffused beam of light toward an object during nocturnal boat launching or docking operations, or other reactively dark hours of the day. The boat hook structure of this invention is floatable, and also may be employed in human rescue operations. By reason of its light weight construction, and telescopic structure, objects at substantial distances from the user can be contacted.

DESCRIPTION OF A PREFERRED EMBODIMENT

Figure 1:
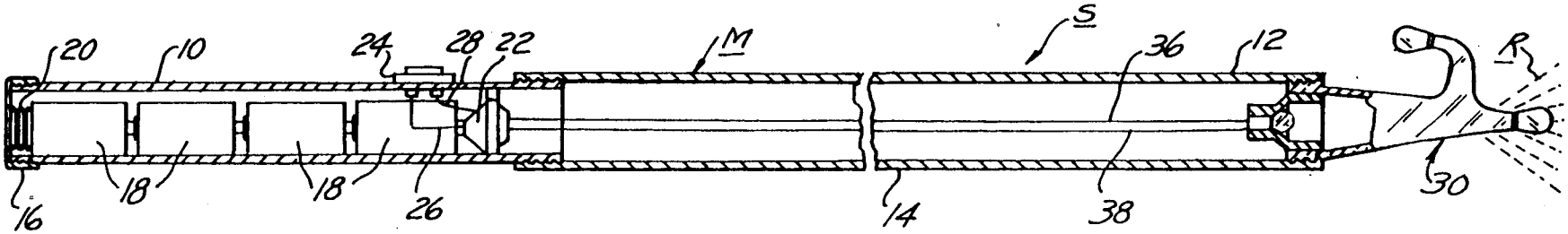
FIG. 1 is a side elevational view of the illuminated boat hook structure of this invention.

Referring now to the drawing, an illuminated or lighted boat hook structure constructed in accordance with the novel concepts of the present invention is designated generally therein by the legend S. The structure comprises a tubular shaft member indicated in its entirety by the legend and which is comprised of a tubular handle portion 10, tubular front or head portion 12, and a plurality of intermediate tubular portions 14, preferably of the telescoping type, although they also may be of the snap-fit variety.

The handle portion 10 has in threadable association therewith cap means 16 and encased by the handle portion 10 is a power source provided in the exemplary embodiment shown by a plurality of "C" size flashlight batteries 18. Spring means 20 is interposed between the cap means 16 and rearmost battery 18 in firm pressing contact therewith. Handle portion 10 also houses wire harness means 22 suitably attached to the inner wall structure of the handle portion 10.

Switch means 24 is conveniently located upon the exterior of the handle portion 10, and is attached thereto in any convenient manner. Wire conductors 26 and 28 connect the switch means 24 to the first series battery 18 and wire harness means 22.

One of the intermediate tubular portions 14 at the rearward end thereof is in threadable connection with the handle portion 10, and tubular front or head portion 12 at the forward end thereof threadably supports clear o essentially transparent plastic hook member 30, the features of which will be shortly described. Suitably mounted by the tubular front portion 12 interiorly thereof in adjacency to the clear hook member 30 is parabolic reflector means 32 receiving therein bulb means 34. Wire conductors 36 and 38 connect wire harness means 22 to bulb means 34.

Figure 2:
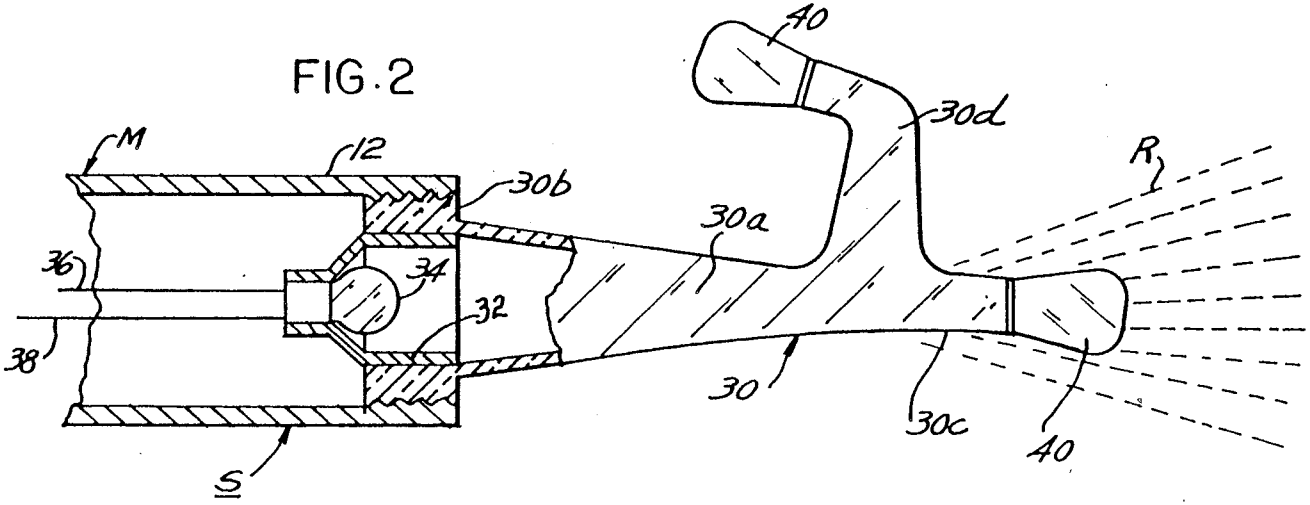
FIG. 2 is a fragmentary detail sectional view thereof.

Referring now particularly to FIG. 2, clear plastic hook member 30 is preferably of solid construction throughout the body thereof. The member 30 is desirably fabricated from one of known polycarbonates which are known to be synthetic thermoplastic resins derived from bisphenol A and phosgene. One such polycarbonate is identified by its manufacturer, General Electric Co., by the registered trademark "Lexan". Polycarbonates are particularly well-suited for the present purposes since they are transparent (90% light transmission), are weather resistant, have high impact strength, and are excellent for all molding methods.

The transparent plastic hook member 30 of this invention is shaped to include a main body portion **30*a* integrated at one end with a threaded collar portion 30*b* and at its opposite end with a stem-like head portion 30*c*. Protruding outwardly and rearwardly from the main body portion 30*a* of the transparent member 30 is hook portion 30*d* of generally right angular configuration. If desired, the extremities of the hook portion 30*d* and head portion 30*c* may mount tip means 40**, which are preferably transparent and may be removed and replaced in the event of wear thereto.

It will now be apparent that applicant has provided an illuminated boat hook structure constructed as to the tubular shaft member of light weight and high strength materials exemplified by aluminum or alloys thereof, and featuring at one end thereof a transparent plastic hook member effective when interiorly illuminated to project an unidirectional diffused beam of light in the manner indicated by the legend shown in FIGS. 1 and 2. By employment of the novel construction herein disclosed, boat docking and launching at night, or other relatively dark hours of the day when visibility is low, can be effectively performed with speed and accuracy. Being telescoping, it may be extended from about six feet to approximately twelve feet and being floatable, applicant's structure can easily be retrieved from the water.

Various modifications to the invention have been noted herein, and these and other changes may of course be effected without departing from the spirit of the invention or the scope of the subjoined claims.

I claim:

1. An illuminated boat hook structure for performance of boat launching and docking operations during conditions of zero or low visibility, comprising a telescoping tubular shaft member which includes at one end a tubular handle section and a tubular head section at the opposite end thereof, a power source received in said handle section, switch means mounted on said handle section, reflector means connected to said head section interiorly thereof, bulb means connected to said reflector means, wiring means interiorly of said tubular shaft means interconnecting said power source, said switch means, and said bulb means, and a solid transparent hook member supported by said tubular head section at the outermost end thereof, said hook member being constructed of a high impact strength clear plastic of high light transmissivity and being shaped to include a main body portion threadably connected to said tubular head section of said shaft member, a hook portion integral with said body portion and protruding upwardly and rearwardly therefrom in generally right angular configuration, and a stem portion integral with said body portion and extending outwardly therefrom forwardly of said hook position, said transparent hook member upon activation of said power source and during zero or low visibility boat docking and launching operations projecting a unidirectional diffused beam of light toward objects which require illumination for the sighting thereof.

* * * * *